US005915457A

United States Patent [19]

Pleschiutschnigg

[11] Patent Number: 5,915,457

[45] Date of Patent: Jun. 29, 1999

[54] METHOD FOR OPERATING A CONTINUOUS CASTING PLANT

[75] Inventor: Fritz-Peter Pleschiutschnigg, Duisburg, Germany

[73] Assignee: Mannesmann Aktiengesellschaft, Düsseldorf, Germany

[21] Appl. No.: 09/011,491

[22] PCT Filed: Jul. 26, 1996

[86] PCT No.: PCT/DE96/01441

§ 371 Date: Apr. 2, 1998

§ 102(e) Date: Apr. 2, 1998

[87] PCT Pub. No.: WO97/04891

PCT Pub. Date: Feb. 13, 1997

[30] Foreign Application Priority Data

Jul. 31, 1995 [DE] Germany ..... 195 29 046

[51] Int. Cl.[6] ..... B21B 1/46; B22D 11/00; B22D 11/124; B22D 11/22

[52] U.S. Cl. ..... 164/476; 164/477; 164/486; 164/455

[58] Field of Search ..... 164/476, 477, 164/417, 486, 414, 455

[56] References Cited

U.S. PATENT DOCUMENTS

| | | | |
|---|---|---|---|
| 4,424,855 | 1/1984 | Tsubakihara et al. | 164/485 |
| 4,658,882 | 4/1987 | Oba et al. | 164/417 |
| 5,065,811 | 11/1991 | Scholz et al. | 164/417 |
| 5,542,165 | 8/1996 | Coassin et al. | 164/417 |
| 5,611,232 | 3/1997 | Rohde et al. | 164/476 |
| 5,634,512 | 6/1997 | Bombardelli et al. | 164/477 |
| 5,771,560 | 6/1998 | Meroni et al. | 164/417 |

*Primary Examiner*—Patrick Ryan
*Assistant Examiner*—I.-H. Lin
*Attorney, Agent, or Firm*—Cohen, Pontani, Lieberman & Pavane

[57] ABSTRACT

A process for operating a continuous casting plant with a continuous casting machine that has a stationary mold and is connected via a roller table to an equalizing furnace. After establishment of the slab format at the mold outlet, at least the casting parameter of casting speed is set so that the slab, upon entry into the equalizing furnace, has the desired roll temperature of the hot strip to be produced, and the lowest point of the liquid pool is always located in the mouth region of the continuous casting machine. Measures are taken to influence the heat energy content of the slab after it leaves the continuous casting machine.

4 Claims, 2 Drawing Sheets

D 50
D 55
D 60
III
II
I
1.2
1.1
1.05
1
h
k
i
g
a
°C
1200
1100
5
7
m/min
CASTING SPEED
AVERAGE SLAB CROSS-SECTIONAL TEMPERATURE AT FURNACE ENTRY

METHOD FOR OPERATING A CONTINUOUS CASTING PLANT

CROSS-REFERENCE TO RELATED APPLICATION

This Application is on 371 of PCT/DE 96/01441, filed on Jul. 26, 1996.

BACKGROUND OF THE INVENTION

1. Field of the Invention

The invention relates to a method for operating a continuous casting plant with a continuous casting machine, which has a stationary mold and is connected via a roller table to an equalizing furnace, The invention further relates to a device for casting strips.

2. Discussion of the Prior Art

From European Reference EP 0 264 459 B1 a process is known for producing hot-rolled steel strip from continuously cast slabs. In this process in which the solidified cast strand is divided into partial pieces of equal length, and these partial pieces are fed one after another into a furnace where they are stored for a period of time before being turned over to a discharge roller table of a finishing train. The molten material for forming the cast strand is cooled in the bow beam or feeding arrangment of the continuous casting machine. The exit temperature of the cast strand at the end of the bow beam is still above 1150° C. The cast strip cools on its way from the mouth of the continuous casting machine to the entrance of the storage furnace, and runs at a temperature of approximately 1150° C. from the roller table into a roller path located in the storage furnace.

The plant needed to implement this process is bound to a set strand thickness and corresponding casting speed. Changes in casting parameters generally result in production declines, reduced quality and increased expense.

For example, a reduction in casting speed at a constant solidification thickness, when no cast-rolling is possible, leads to sharp temperature-output losses, due to the additional cooling of the slab in the continuous casting plant as well as to the long holding time of the strand on its way to the equalizing furnace.

In addition, because no shears are used, the cross-cutting machine known from the aforementioned document leads to high radiant losses as a result of the long process time.

SUMMARY OF THE INVENTION

The object of the present invention is to provide a process and a device with which the casting parameters of a preestablished production chain, comprising a continuous casting plant, equalizing furnace and rolling mill, can be changed, using simple means, while the casting output is at least maintained.

The invention is based on the realization that when the continuous casting stage is linked to the rolling stage during the casting of billets, slabs and, particularly, thin slabs, the energy content of the strand entering the temperature equalizing furnace, roller hearth or cross-transfer furnace that follows the continuous casting plant is of great significance. Surprisingly, the energy content of the slab entering the equalizing furnace can be used as a control variable for the operation of the entire plant. The energy content of the slab upon its entry into the equalizing furnace is thus set to the desired roll temperature of the hot strip to be produced. The furnace can thereby be operated so that no energy need be supplied to the strand; instead, the strand even serves to equalize the slab temperature.

With the selected slab temperature at entry into the equalizing furnace serving as a fixed point, the steel worker is free to vary the parameters in the downstream plant parts. Unexpected solutions are found when, given a basic layout (e.g., solidification thickness of 60 mm at a casting speed of 5 m/min), the solidification thickness of the slab is reduced and influence is exercised on the casting speed, apart from influence variables such as strand cooling or insulation between the strand casting machine and the furnace.

Another possibility of increasing casting output in conjunction with a higher heat content of the slab entering a furnace directly downstream from the continuous casting plant is created by cast-rolling in the casting machine, i.e., by reduction of the casting thickness during solidification.

According to the invention, after the slab format is determined at the mold outlet, the casting parameters are set so that the slab entering the equalizing furnace corresponds to the desired roll temperature of the hot strip to be produced. The system then allows the casting output to be increased while a constant casting thickness and maximum casting speed are maintained, and also permits control of the heat content of the slab entering the equalization furnace. The parameters are thereby set so that the lowest point of the liquid pool is always located in the mouth region of the strip casting machine. Depending on the current energy content of the strand directly after the continuous casting machine, heat is extracted in a predetermined way from the slab by means of an active cooling device, or heat radiation is prevented to the greatest extent possible by means of an insulating device.

The basic layout of a continuous casting plant with a slab solidification thickness of 60 mm and a maximum possible speed of 5 m/min calls, for example, for a metallurgical length of 9.3 m. If the solidification thickness is reduced from 60 to 50 mm by cast-rolling or by conversion of the continuous casting machine, then, while maintaining the casting speed, the production output is reduced, taking into account the fact that radiant losses increase as a function of decreasing slab thickness and, at the same time, the solidification time of a strand with decreasing thickness declines with the square of the half thickness.

If, on the other hand, contrary to the usual procedure, the casting speed increases as a function of the lessening thickness to its maximum value of 7.2 m/min, then, given a slab of the same width, casting output increases from 2.31 to 2.77 t/min, i.e., from 100 to 120%. It is possible not only to maintain casting output, but actually to increase it by this measure. At the same time, using this procedure, the energy content rises, and thus the corresponding average slab temperature at the furnace entrance increases from 1111° C. to 1150° C.

This temperature increase can make it necessary to set the temperature of the slab to the level desired at the furnace entry by means of cooling in the area of the roller table in front of the equalizing furnace.

This process technology permits energy-neutral furnace operation while ensuring the desired energy content of the slab at the furnace entrance and the suitable roll temperature at the furnace exit. Such a system can also permit different roll temperatures from slab to slab, because the furnace essentially functions only as an equalizing furnace, i.e., neutrally, and need no longer perform any heating functions.

Along with these energy-related advantages, the invention provides other advantages, such as:

Improved casting structure due to the cast-rolling process during solidification; and Increased slag lubrication film in the mold, which leads, first of all, to reduced heat blockage in the mold and thus to a lesser thermal load of the strand shell (reduction in stresses and avoidance of cracks), and the mold plate (increase in mold durability).

BRIEF DESCRIPTION OF THE DRAWING

An example of the invention in shown in the accompanying drawings. The drawings show.

DETAILED DESCRIPTION OF THE PREFERRED EMBODIMENT

Figure 1:
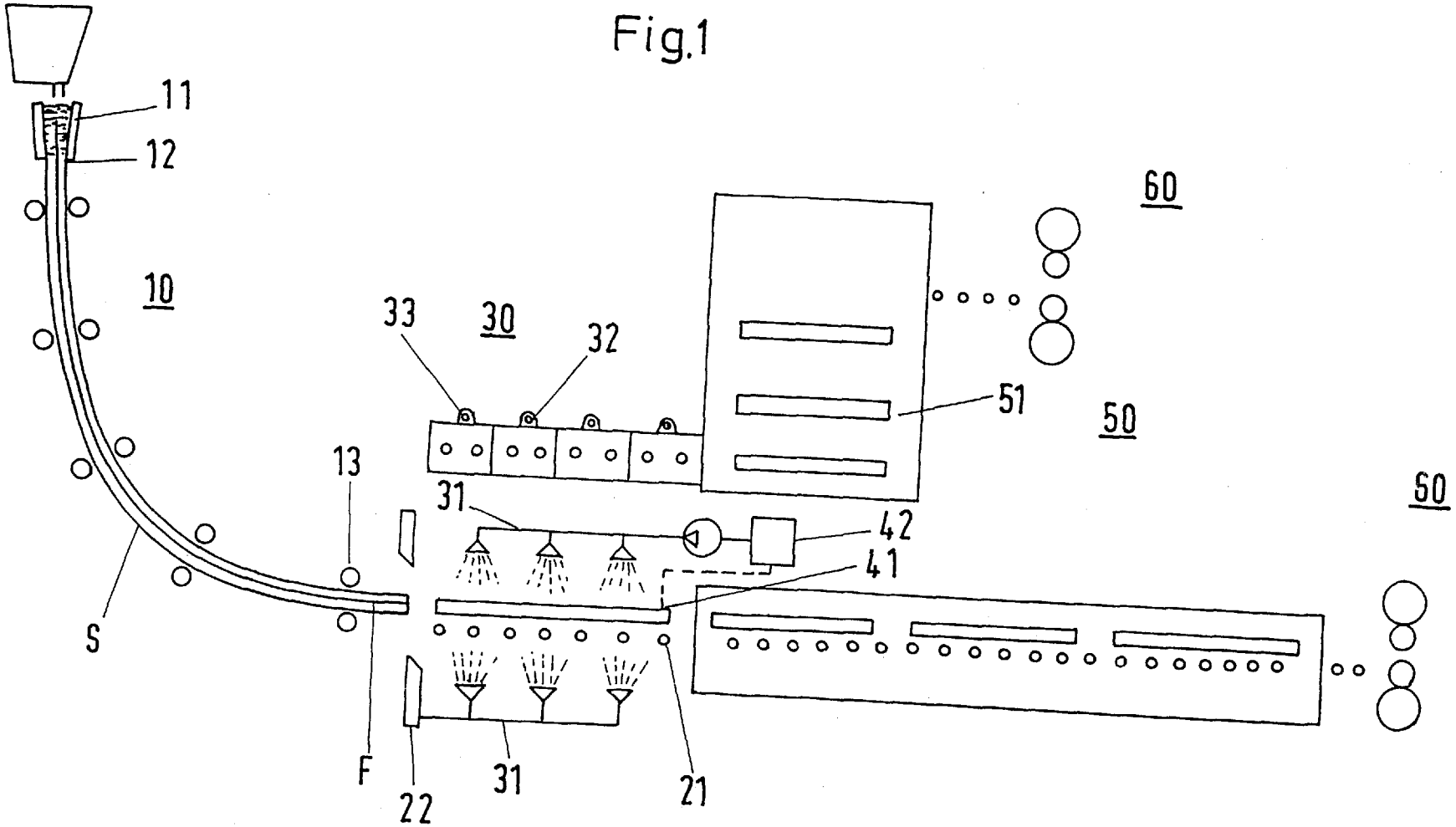
FIG. 1 is a diagram of the continuous casting plant.

FIG. 1 shows a continuous casting machine 10 with a stationary mold 11. A strand S extends from the mold outlet 12. In the strand S, the lowest point of the liquid pool F extends to the mouth 13 of the continuous casting machine 10.

Attached to the continuous casting machine 10 is a roller table 21, which establishes the shortest possible connection, e.g., 10 m in length, to an equalizing furnace 50. In the upper part of the FIG. 1, a cross-transfer furnace 51 is shown; in the lower part FIG. 1, there is a roller hearth furnace 52.

Further, for influencing the heat content of the slab, there are insulation hoods 32 in the area of the roller table 21 in the upper part of FIG. 1, and cooling elements 31 in the lower part of FIG. 1. A thermal sensor 41 senses the temperature of the slab at the end of the roller table 21 and outputs this information to an actuator 42 which controls the cooling elements 31. The hoods 32 are provided with construction elements 33 that facilitate easy disassembly of the hoods 32.

The continuous casting machine 10 has a metallurgical length of 9.3 m. The roller table 21 has a length of 10 m. The slabs are separated by a cross-cutting device 22 into lengths of approximately 43 m, so that the cross-transfer furnace 51 has a length of around 45 m and the roller hearth furnace 52 has a length of 150 m.

Attached to the equalizing furnace 51 or 52 is a standard rolling mill 60 for producing hot strips of 1 mm thickness. The rolling mill 60 can comprise, for example, a two-stand roughing stage with an attached coiling station and finishing train.

Figure 2:
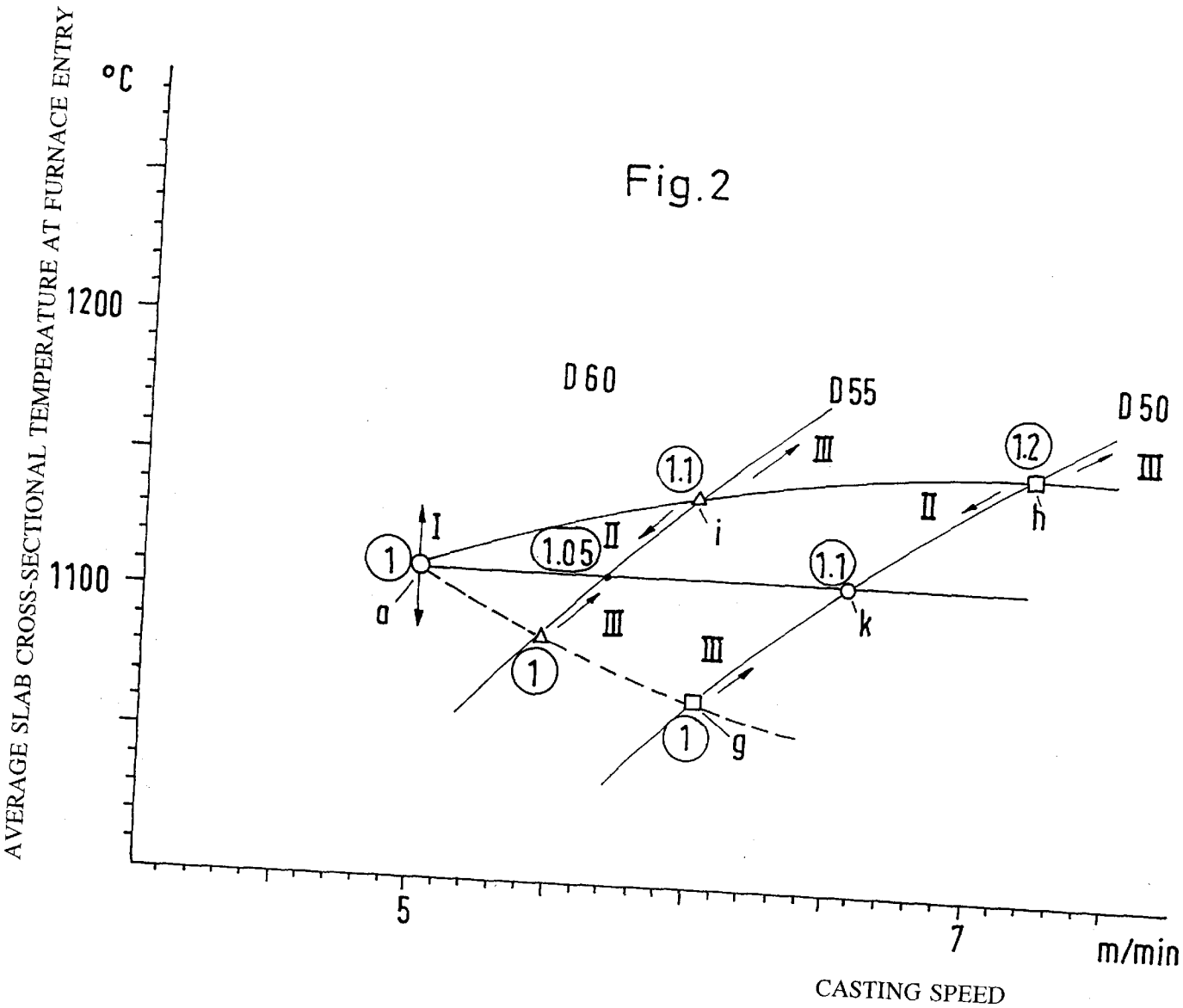
FIG. 2 is a chart of average slab temperature as a function of casting speed.

FIG. 2 shows a) the standard situation at the entry of the equalizing furnace located 10 m from the end of the continuous casting plant, in a basic layout for a solidification thickness of 60 mm and a casting speed of 5 m/min. In the continuous casting machine, approximately 0.3 to 0.5 l water/kg steel of sprayed water is cooled to the extent that the slab at the end of the machine has an average temptera-ture of 1325° C. At a speed of 5 m/min, this slab, upon entering the equalizing furnace, has a temperature of 1111° C.

If the slab thickness is reduced to 50 mm, the following situations result:

Given the usual increase in casting speed from 5 to 6 m/min and a constant casting output, the surface temperature of the slab declines and the slab enters the equalizing furnace (point g) at only 1067° C. According to the invention, to permit the slab temperature to be increased, the strand is insulated in the area of the roller table. The drop in temperature is thus reduced (see arrow pointing toward point III). In this case, the result is a constant production quantity (see the straight line through points a) and k).

On the other hand, if the casting speed is increased more than would correspond at an increase at a constant slab thickness, for example, if the casting speed is brought approximately to its maximum value, and the taking into account of the establishment of the lowest point of the liquid pool at the end of the machine, then a temperature increase occurs; in the present case, 1150° C. is expected upon entry into the equalizing furnace (point h). If this temperature is too high for the desired rolling method, heat can be withdrawn from the strand by means of cooling.

Point i) shows the expected capacity-temperature increases given a slab thickness of 55 mm and a possible casting speed of 6 m/min.

All told, it has been found that at a maximum speed of 7.2 m/min and with cast-rolling, as needed, from 60 to 50 mm slab thickness, an increase in casting output from 2.31 t/min to 2.77 t/min is realistic. A temperature increase in the slab from 1111 to 1150° C. at the entry to the equalizing furnace is attained, after free radiation between the continuous casting machine and the equalizing furnace.

The straight lines show the relationships between particular slab thicknesses; the index gives the thickness D in each case.

The roman numerals in FIG. 2 show the possibility of influencing individual slab thicknesses relative to the influence on the temperature of the slab, specifically:

I shows the variation in sprayed water quantity in 1 water/kg steel

II shows the cooling between the continuous casting machine and the furnace; and III shows the insulation between the continuous casting machine and the equalizing furnace The encircled values show the relative casting output. For example, at Point h) it is possible to increase casting output by a factor of 1.2 compared with the casting output at Point a).

I claim:

1. A process for operating a continuous casting plant with a continuous casting machine that has a stationary mold and is connected via a roller table to an equalizing furnace, comprising the steps of:

establishing a slab format of casting parameters at an outlet of the mold;

subsequently setting at least a casting speed so that the slab, upon entry into the equalizing furnace, has a desired roll temperature of hot strip to be produced, and so that a lowest point of the liquid pool is always located in a mouth region of the continuous casting machine;

changing the casting speed upon reducing slab thickness, to an extent greater than an inverse relationship of the cross-sectional surfaces at the format conversion; and influencing heat energy content of the slab after the slab leaves equalizing furnace of the continuous casting machine.

2. A process as defined in claim 1, and further comprising the step of reducing the format of the slab after the slab leaves the mold in the strip casting machine by cast-rolling.

3. A process as defined in claim 1, wherein the heat energy influencing step includes extracting heat from the solidified slab with a cooling medium.

4. A process as defined in claim 1, wherein the heat energy influencing step includes insulating the solidified slab so that heat radiation is minimized.

* * * * *